US005145061A

United States Patent [19]

Marceau

[11] Patent Number: 5,145,061

[45] Date of Patent: Sep. 8, 1992

[54] SAFE-T-SAND

[75] Inventor: David J. Marceau, 1110 Pleasant Ave., Bremerton, Wash. 98310

[73] Assignee: David J. Marceau, Bremerton, Wash.

[21] Appl. No.: 670,919

[22] Filed: Mar. 18, 1991

[51] Int. Cl.[5] ..... B65D 69/00; B65D 85/00

[52] U.S. Cl. ..... 206/223; 206/803; 206/524.1

[58] Field of Search ..... 15/257.1; 206/803, 568, 206/572, 223, 524.1

*Primary Examiner*—William I. Price

[57] ABSTRACT

My invention is a product comprised of an absorbent mixture (1) consisting of clay to absorb and contain toxic fluids which has been mixed with orange fluorescent chalk to enhance the visibility. The bright orange material becomes a warning device, alerting the public to a possible hazard. The absorbent is provided in a moisture-resistant container with means for pouring and with an opening that can be reclosed. There is a scoop (2) to clean up the waste materials, and a plastic bag (3) with lock top means for the storage and transportation of the waste materials prior to disposal.

7 Claims, 2 Drawing Sheets

SAFE-T-SAND

BACKGROUND OF THE INVENTION

My invention relates to the field of conservation, specifically to spills of toxic substances.

Trucking vehicles have indeterminant and unpredictable spills of toxic fluids including oil or fuel leaks, leaks in hydraulic and coolant systems as well as others.

My invention provides an easy, safe and inexpensive method to contain and absorb a spill prior to its clean-up and a means to handle and store the waste materials prior to disposal.

These spills can occur while vehicles are in use on private or public roadways, streets, highways, bridges, ferries, or while parked on those roadways or in areas designated or undesignated as parking areas or facilities.

These spills can be a hazard, a pollutant to the environment, a public nuisance, or simply unsightly and messy. All have in common the difficulty of expedient cleanup.

As the reader can see, my invention meets an urgent need by providing a means that can be carried in a truck at all times, just as one would carry other precautionary safety means such as first aid kits, fire extinguishers, flares and communications devices. And the reader will see also, the use of this invention is directed to but not limited to commercial trucking vehicles, and has other markets, related and unrelated.

BACKGROUND-PRIOR ART

Heretofore, clean up of leaks and spills from vehicles has been approached as follows:

After a spill occurs, the driver calls the maintainance shop or company dispatcher, reports the spill and its location. Sometimes the driver may put up reflective triangles as a warning before he continues on his way or he may stay to direct traffic. Meanwhile the spill is spreading by natural means such as gravity and seeping into the surface by means such as holes, cracks, and osmosis, spreading to drainage systems, water systems, and spreading by way of automobiles, animals, people and other means from direct contact with the spill. Until a crew arrives to clean and clear the spill, contamination of the surroundings moves insidiously outward.

Toxic chemical compounds and products such as naptha or gasoline have been used for many years as the means to clean up these spills. The choice to use these means is usually due to habit, unconcern or ignorance of their toxic affects, convenience, or simply due to not having a better choice available. Plain gray/tan absorbent clay is available, performs well and without adding toxins. Absorbent towels can be used, but are not efficient and also are a waste of a natural resource. There is a kit on the market containing absorbent material, but the cost is prohibitive for the need that my invention answers.

As the reader knows, in all probability there are untold amounts of these spills that are never cleaned or contained at all, in any manner.

OBJECTS AND ADVANTAGES

Accordingly, I claim several objects and advantages of my invention are these:

Provides an expedient and proper way to contain, cleanup and clear away toxic spills using an absorbent composition that is in itself organic, bio-degradable, and safe for the environment.

Prior to clean up, the area covered by the spill is marked with a bright flourescent orange color warning motorists, cyclists and pedestrians of a possible hazard which by being made aware of, they can choose to avoid.

Provides a container in which to store and transport the spent and contaminated waste material to a proper place for environmentally sound disposal.

Provides a scoop for picking up the waste materials.

Provides an extra bag for storage of the waste materials when the spill is small and does not require the entire absorbent mixture at one application.

My invention is inexpensive to manufacture, takes a relatively small storage space, has an infinite storage life, is ready for instant use and is a complete entity in itself.

Adherence to conservation regulations is becoming increasingly more compelling.

More people will use a product that has been designed for a specific use. Most people will not think of using or asking for a generic substance that will perform the function they require. But, they will purchase a product—by recognizing a brand-name, remembering an advertisement, or when seeing something they need on the merchants shelf.

The public as a whole is not cognizant of correct materials to use and thus can be guilty of giving or following inproper methods and/or advice.

By having this invention available in their vehicles, owners and/or drivers may incur a reduction of liability in the same manner as being a non-smoker or non-drinker and wearing a seatbelt contributes to safety and reduces the cost of insurance.

My invention meets an existing need, has an untapped commercial and retail market, is inexpensive and easy to manufacture, and uses components that are common, abundant and readily available.

There exists in my invention an inherent value whereby publicity of the product could be a catalyst to ensure prompt clean-up of spills by drivers either commercial or private.

And, there is a market for my invention in those establishments which are involved with aiding the public motorist, such as police.

And, private vehicle owners too could become more aware of the need to clean-up their own small spills and to dispose of the waste materials in an environmentally friendly manner, another market for my invention.

The following advantages are not exclusive to my invention. However the reader will see that they are applicable and relevant.

The eco-system—people, animals, birds, insects, fish, water supplies, rivers, streams, lakes, oceans, trees, plants, land, any living entity—could be spared the adverse affects of additional contamination from these spills.

Conservation of natural resources is enhanced directly and indirectly by avoiding the use of limited resources such as water and by not using additional toxic substances for cleanup.

Reduces the threat of spontaneous combustion or ignition of the fluid from sparks, flame, heat or other source.

Toxic fluids can be harmful to children, pets and wildlife who are attracted to the physical properties and can be poisoned through contact or consumption. Animals will be unwilling or unable to consume the treated fluids.

People and animals often walk inadvertently on contaminated surfaces, spreading the contaminants elsewhere.

Clean-up of spills has esthetic value, in that the fluids leave a residue on surfaces that is unsightly, messy and generally objectionable.

Again, the reader can see the value in having a specific, inexpensive, readily available product for instant use.

In summation, I claim objects and advantages of my invention include but are not exclusive to the following:

1. Expedient and safe way to contain vehicular toxic spills
2. Provides convenient, safe way to dispose of contaminated materials
3. Warns of the spill
4. Easy to use
5. Available for instant use
6. Inexpensive to purchase
7. Easy to transport
8. Easy to store
9. Long storage life
10. Self-contained
11. Simple easy to use directions
12. Addresses an existing need
13. Composed of organic, bio-degradeable materials
14. Benefits eco-system by decreasing amount of contamination
15. Protects life forms from possible poisoning
16. Could prevent accidents which occur when motorists, cyclists and pedestrians come in direct contact with the spills
17. Reduces fire potential at scene of spill
18. Returns esthetic quality of spill area closer to that which existed prior to the spill
19. Untreated spills can be a public nuisance
20. Assists in compliance of conservation regulations
21. Could reduce liability to owner/driver
22. Could be used to clean up other toxic spills
23. Having a specific product increases response to a need
24. Has commercial and retail value
25. Inexpensive to manufacture
26. Simple to manufacture
27. Uses existing, readily available, common elements
28. Has other market value beyond the trucking industry
29. Has other-use value, including but not exclusive to: an emergency traction enhancement, and an emergency device for warning of roadway hazards.

These illustrations of the objects and advantages demonstrate to the reader the uses, benefits and practical nature of my invention.

DESCRIPTION OF THE DRAWING

The drawing for my invention consists of illustrations of possible containers, (FIGS. 1, 4, 5, 6) a scooping device, (FIG. 2) and an adjunct container for disposal, (FIG. 3) plus an illustration (FIG. 7) showing the application.

REFERENCE NUMERALS TO DRAWING

Figure 1:
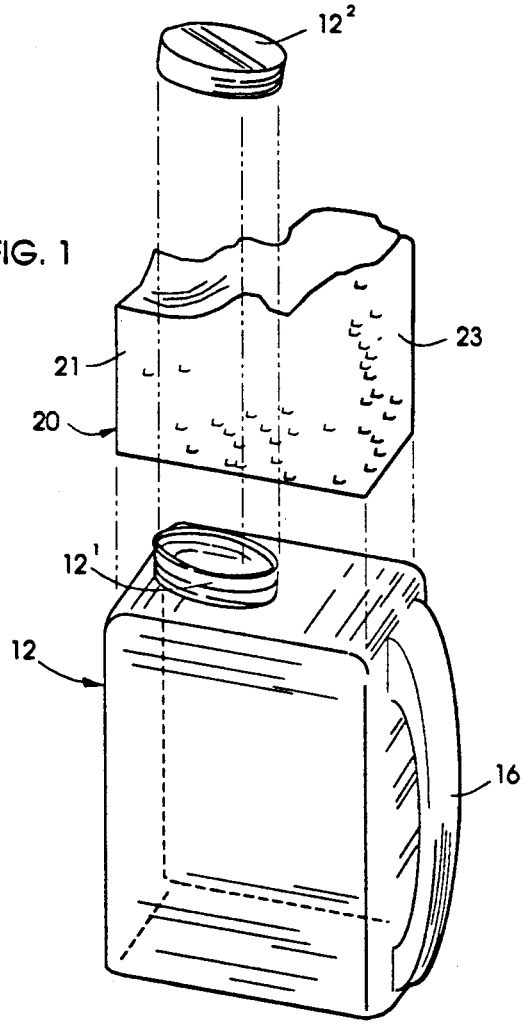
FIG. 1. is an example of a container (12) with a handle, lid (12.2) and pouring spout (12.1) made of semi-rigid, transparent plastic and shows the bright orange absorbent mixture (1) inside.
Figure 4:
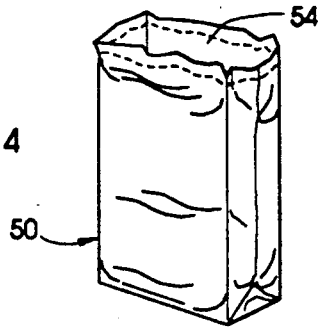
FIGS. 4., 5., and 6. are alternative styles for containers consisting of opaque or transparent plastic or paper. The paper containers have moistureresistant liners or coatings.
Figure 5:
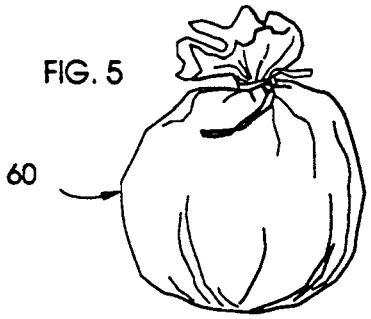
Figure 6:
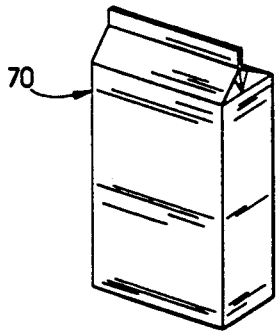
Figure 2:
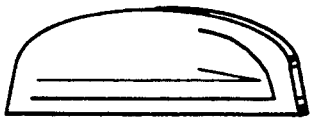
FIG. 2. is a possible style of tool for clean up.
Figure 3:
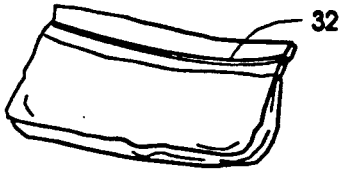
FIG. 3. is a type of plastic bag with locking top (32) for disposal of a small amount of waste materials.
Figure 7:
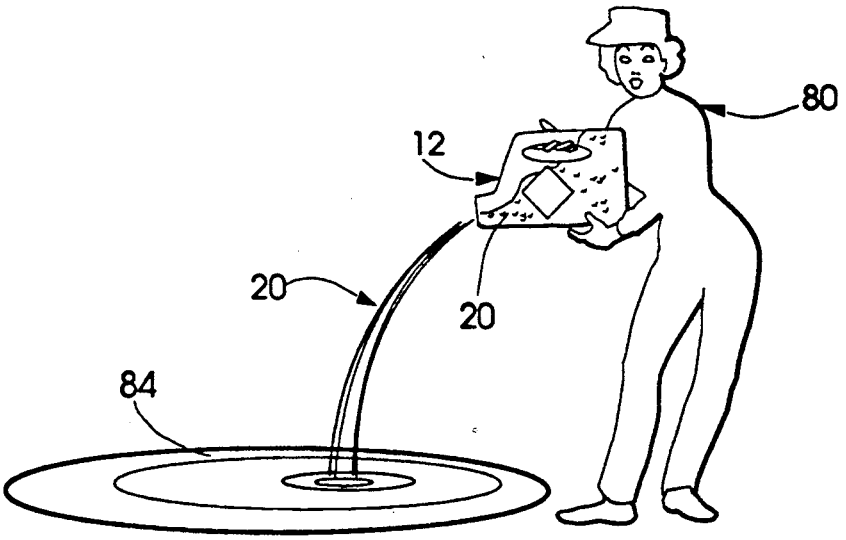
FIG. 7. is an illustration of my invention in use.

FIG. 1. Plastic container (12) with means to reclose (12.1, 12.2) showing absorbent mixture (1).
FIG. 2. Scoop.
FIG. 3. Plastic bag.
FIG. 4. Paper bag.
FIG. 5. Plastic bag with means to reclose (32)
FIG. 6. Paper box.
FIG. 7. Illustration of use

A NARRATIVE DESCRIPTION OF THE STRUCTURE

Hereto is a concise, complete description showing how to easily build my invention.

Take an absorbent material such as clay and mix with a coloring additive such as chalk. These two, in this instance the clay and the chalk, make up the entire composition (1).

Place this bright orange composition (1) in a moisture-resistant container. The container (12) should be designed to allow for easy pouring of the contents (1) and to have an opening that can be reclosed (12.1, 12.2). The only other requirements are that a person should be able to easily carry, transport and store the container. The container can consist of a variety of materials, designs and sizes that are readily available on the market (FIGS. 1, 4, 5, 6). It is not necessary to design or manufacture a special kind of container as the features required are already available in containers now being manufactured.

And then a simple scoop (FIG. 2) also already designed, manufactured and available, can be included affording a tool for clean-up.

And also, a small plastic bag (FIG. 3) can be included for disposing of a small amount of waste materials.

The reader will note that it is this assembly of common elements and the resultant timeliness of function that combine to make my invention unique and synergistic.

AN EXPLANATION OF HOW THE INVENTION WORKS

The user (FIG. 7) pours the contents (1) of the container (12) around the perimeter of the spill of a toxic fluid. This stops the spread of the fluid and at the same time begins to absorb the fluid. The user then pours the remaining absorbent mixture (1) onto the body of the spill which will absorb the remaining fluid. Meanwhile, the bright orange color acts as a warning device. After the fluid is absorbed, the user scoops up the waste material with the provided scooping tool (FIG. 2). The user can then place this waste mixture into the original container (12) or the small bag. After closing the bag (FIG. 3) or container, the user can safely at a convenient time properly dispose of the toxic materials. The product is of a size that can be readily stored in a vehicle, and easily carried to and away from the site of an emergency.

The reader knows that in regard to spills "time is of the essence," which creates intrinsic value in my invention. Because the product is always available in the truck, along with other emergency equipment, it is easy for the user to take care of the spill in an expedient manner.

A CONCLUSION AND ONE OR MORE BROADENING PARAGRAPHS

There exists a wide need for a simple, effective, on-the-spot way to contain, clean up and take away toxic waste from spills emanating from trucking vehicles. The methods employed at this time are inefficient due in part to the time-lag between the time the spill occurs and the time of clean up. This timelag allows for spreading of the fluids, possibly into drainage systems and water-ways and the contamination of the surrounding areas. There is the possiblity of hazard to motorists, cyclists, pedestrians by creation of collisions or by fire. Curtailing this time-lag by treating the spill as soon as it occurs benefits a wide range of life forms. Some other reasons for the poor response to this need are: Lack of knowledge, ignorance of responsibility, evasion and cost.

With a known method for clean up available, there is less cause for ignoring this responsibility. Having a proven product available puts the ability to act and the responsibility to be timely on the owner/driver where it belongs.

Although not specifically intended for this purpose, my invention could also be used as an emergency traction enhancement. The absorbent composition can create more traction for a vehicle when the absorbent is placed on ice or snow. And again, the bright orange color could warn other motorists to avoid the area. To further implement the night time visibility, mica can be added which would pick up and reflect light sources.

My invention could also be used as an emergency warning enhancement for other roadway and airway hazards, until authorities could arrive to clear the scene. For example, the product could be spread around the perimeter of such happenings as downed powerlines, a pothole, a missing manhole cover, an object on the roadway—the bright orange color illuminating the outline of the hazard. It could be used to form directional arrows and such, providing an emergency means to direct attention. An example: Emergency landing arrows for a small aircraft.

The reader can readily see that this is a complete process, that it is simple, expedient, and addresses a wide concern.

I claim

1. A kit including a container with a composition of an absorbent material and an additive mixed with said absorbent material to enhance the visibility of said material when applied to a surface.

2. The kit of claim 1 wherein the absorbent material is clay for absorbing and containing toxic fluids.

3. The kit of claim 2 wherein the additive is chalk.

4. The kit of claim 3 wherein the chalk is an orange flourescent.

5. The kit of claim 2 wherein the additive is chalk and mica chips.

6. The kit of claim 2 wherein the kit includes a scoop to clean up waste material in the form of absorbed toxic fluids and a plastic bag with lock top means for the storage and transportation of the waste material prior to disposal.

7. The kit of claim 1 wherein the container is moisture-resistant.

* * * * *